US006433666B1

(12) United States Patent
Inoue et al.

(10) Patent No.: US 6,433,666 B1
(45) **Date of Patent: *Aug. 13, 2002**

(54) THERMISTOR ELEMENTS

(75) Inventors: Hidehiro Inoue; Yuichi Takaoka, both of Shiga (JP)

(73) Assignee: Murata Manufacturing Co., Ltd., Kyoto (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/032,940

(22) Filed: Mar. 2, 1998

(30) Foreign Application Priority Data

Mar. 18, 1997 (JP) ..... 9-064351

(51) Int. Cl.[7] ..... H01C 7/10; H01C 7/13
(52) U.S. Cl. ..... 338/22 R; 338/308; 338/25
(58) Field of Search ..... 338/22 R, 308, 338/309, 25

(56) References Cited

U.S. PATENT DOCUMENTS

| | | | | | |
|---|---|---|---|---|---|
| 3,568,125 | A | * | 3/1971 | Villemant | 338/22 |
| 3,766,511 | A | | 10/1973 | De Vries et al. | |
| 3,849,757 | A | * | 11/1974 | Khammous et al. | 338/320 |
| 4,126,583 | A | * | 11/1978 | Walter | 252/521 |
| 4,359,372 | A | * | 11/1982 | Nagai et al. | 204/192 |
| 4,684,916 | A | * | 8/1987 | Ozawa | 338/308 |
| 4,695,818 | A | * | 9/1987 | Kloiber | 338/22 R |
| 4,891,977 | A | * | 1/1990 | Johnson et al. | 338/309 |
| 5,142,263 | A | * | 8/1992 | Childers et al. | 338/21 |
| 5,258,736 | A | | 11/1993 | Kristen et al. | |
| 5,294,910 | A | * | 3/1994 | Tani et al. | 338/306 |
| 5,379,017 | A | * | 1/1995 | Katsuno | 338/332 |
| 5,543,208 | A | | 8/1996 | Hasler | |

FOREIGN PATENT DOCUMENTS

| | | | |
|---|---|---|---|
| DE | 3433196 A1 | | 9/1983 |
| DE | 4410468 A1 | | 3/1993 |
| JP | 6-215908 | | 8/1994 |
| JP | 7-29704 | | 1/1995 |
| JP | 10-48062 | * | 2/1998 |
| JP | 10-62264 | * | 3/1998 |

OTHER PUBLICATIONS

Patent Abstract of Japan 05175014 A "Manufacture of Chip Ceramic Electronic Component" (No date).

* cited by examiner

*Primary Examiner*—Elvin Enad
*Assistant Examiner*—Kyung S. Lee
(74) *Attorney, Agent, or Firm*—Beyer Wearver & Thomas LLP

(57) ABSTRACT

A thermistor element has a pair of electrodes formed in ohmic contact with and mutually opposite to each other on one of the surfaces of a thermistor body. These electrodes each have a thin-film contact layer and an external electrode layer which is formed either directly or indirectly over the contact layer and only on the surface on which these electrodes are formed opposite each other and is of a metallic material such as Au, Ag, Pd, Pt, Sn and their alloys.

18 Claims, 8 Drawing Sheets

THERMISTOR ELEMENTS

BACKGROUND OF THE INVENTION

This invention relates to thermistor elements which are used for detection of temperature and temperature compensation of circuits. In particular, this invention relates to thermistor elements having an external electrode structure which is suited for surface mounting.

Since high-density mounting of electronic components is desired, thermistor elements are required to be surface-mountable, say, to a printed circuit board. FIGS. 13 and 14 (or FIGS. 13A, 13B, 14A and 14B) show examples of prior art surface-mountable thermistor elements.

FIGS. 13A and 13B show a thermistor element 61 having electrodes 63 and 64 formed so as to cover the two end surfaces of a thermistor body 62 made of a material with resistance having a negative temperature coefficient (NTC). These electrodes 63 and 64 are each formed not only on one of the end surfaces of the thermistor body 62 in the shape of a rectangular parallelepiped but also so as to reach the remaining four surfaces adjoining that end surface, that is, the upper, lower and two side surfaces. Thus, such a thermistor element 61 could easily be surface-mounted by attaching its lower surface 62*a* to an electrode land formed on a printed circuit board, for example, by soldering.

FIGS. 14A and 14B show a thermistor element 65 of the type disclosed in Japanese Patent Publication Tokkai 7-29704, characterized as having a first electrode 67 and a second electrode 68 formed on the lower surface of a thermistor body 66 in the shape of a rectangular parallelepiped so as to be mutually opposite to each other with a specified distance therebetween. If such a thermistor element 65 is desired to be miniaturized and the distance between its electrodes 67 and 68 is excessively reduced, however, there arises the danger of a short-circuiting.

In order to prevent the occurrence of short-circuiting, the thermistor element 65 is provided with an insulating layer 71 of an inorganic material, as shown in FIGS. 14A and 14B, so as to cover the lower surface of the thermistor body 66 between two external electrodes 69 and 70 which are formed respectively on the first and second electrodes 67 and 68, separated from each other by a distance larger than the gap between the first electrode 67 and the second electrode 68. Since the first and second electrodes 67 and 68, as well as these external electrodes 69 and 70, are all formed only on the lower surface of the thermistor body 66 without reaching any other surfaces, the thermistor element 65, too, can be easily surface-mounted by attaching its lower surface 66*a* to a printed circuit board, for example, by using a solder for reflow mounting or flow mounting.

With the thermistor element 61 shown in FIGS. 13A and 13B, each of the electrodes 63 and 64 is formed so as to reach five of the surfaces of the thermistor body 62. Thus, although it can be surface-mounted, say, onto a printed circuit board by soldering, the solder tends to form swollen parts referred to as "fillets" which make high-density mounting difficult. This may be explained as follows. Suppose that the thermistor element 62 is surface-mounted onto a printed circuit board by applying a solder on the lower surface 62*a* of the thermistor body 62. If this is done, the parts of the electrodes 63 and 64 situated on the lower surface of the thermistor body 62 may be joined by the solder but the molten solder will swell along the three surfaces perpendicular to the lower surface of the thermistor body 62 and fillets are thereby formed. Thus, the area required for the mounting becomes far greater than the flat area of the thermistor element 61. This is a serious problem in the attempt to achieve high-density mounting.

As for the thermistor element 65 shown in FIGS. 14A and 14B, on the other hand, the external electrodes 69 and 70 for making connections are provided only on the lower surface of the thermistor body 66. Thus, there is no problem of fillets and hence the area for mounting can be made smaller and higher-density mounting can be accomplished than in the case of the thermistor element 61 of FIGS. 13A and 13B. The thermistor element 65 of FIGS. 14A and 14B, however, was originally for using a reflow mounting method with a solder paste or a flow mounting method with molten solder. Thus, higher mounting densities are very difficult to achieve with such mounting methods, for example, for the following reasons:

(1) High density mounting is not possible unless solder lands to be formed (say, on a printed circuit board) by a printing process is done with a high degree of accuracy but there have been limits to the accuracy in the printing of solder lands;

(2) When a solder material is melted, the thermistor element tends to be displaced from the solder land onto the base board; and (3) It is difficult to control the thickness of a solder layer and hence it was difficult to control the mounting displacement of the thermistor element in the direction of the height.

By the reflow and flow methods, furthermore, the mechanical strength of joint becomes weaker due to the embrittlement of the solder and the electrical connections of the chip parts are sometimes deteriorated. Since thermistors which are used for the detection of temperature are required to be accurate to the level of about 1%, such a deterioration of electrical contacts could be a fatal defect.

Recently, a new mounting method referred to as the bump mounting is becoming popular as an improved method of mounting by which higher density mounting becomes possible than by the reflow or flow mounting method. The bump mounting method is a technology whereby a cylindrical or square pillared protrusion called a bump, usually comprising Au or Sn—Pb, is inserted between a chip component and a base board and the bump is joined together with the board and the chip component by thermocompression bonding or by eutectic alloy formation.

By this method, a bump can be formed on a chip component or a base board with very high accuracy and, as long as a bump can be formed accurately, the chip component can be accurately attached to the base board. Another advantage of this method is that there is no problem of fillets.

Among the bump joints, Au bump joints are particularly favorable because they have a high mechanical strength and hence there is no embrittlement problem of the kind encountered with solder materials. Thus, reliable joints can be thereby realized.

The prior art thermistor elements 61 and 65 described above, however, are not suited for bump mounting because they were basically intended to be mounted by using a solder material, having the base layers for their electrodes comprised of a conductive paste. In other words, the electrodes 63 and 64 are formed by applying a conductive paste on a thermistor body 62 and baking it in order to obtain base layers and then forming a layer of Sn or a Sn—Pb alloy in order to improve the solder wettability. As for the thermistor element 65, its first and second electrodes 67 and 68 are formed by applying a conductive paste such as of Ag on the lower surface 66*a* of the thermistor body 66 and then subjecting them to a baking process.

Thus, if external electrode layers for external connections are formed by plating Ni or Sn—Pb on the electrodes formed by applying a conductive paste and subjecting it to a baking process as described above, the base layers are thick and uneven. As a result, the surfaces of the external electrodes thereabove were necessarily also uneven.

If a thermistor element is to be mounted onto a base board by a bump mounting method, the bumps and the electrodes of the thermistor element must be firmly in contact with each other. Thus, if the thermistor has external electrodes with very uneven surfaces with large indentations and protrusions, a dependably firm contact cannot be expected by a bump joint method.

SUMMARY OF THE INVENTION

It is therefore an object of this invention to provide thermistor elements suitable for surface mounting by bump joints, having reliable connections.

A thermistor element according to this invention, with which the above and other objects can be accomplished, may be characterized not only as comprising a thermistor body and a pair of electrodes formed mutually opposite to each other on one of the surfaces of the thermistor body, but also wherein these electrodes are in ohmic contact with the thermistor body and each comprise a thin-film contact layer and an external electrode layer which is formed either directly or indirectly over the contact layer and only on the surface on which the pair of electrodes is formed opposite each other and is of a metallic material such as Au, Ag, Pd, Pt, Sn and their alloys. Since the contact layer of each electrode is formed by a thin-film forming method, its surface is much smoother than the surfaces of prior art thick-film electrode layers formed by applying a conductive paste and subjecting to a firing process. As a result, the external electrode layer which is formed thereover also has a much smoother surface than those of prior art thermistor elements. Thus, when a thermistor element according to this invention is mounted by a bump bonding method, there is an improved reliability in the connection between the bumps and the external electrode layer. Thermistor elements according to this invention, however, may be mounted by a flow or reflow method using a solder. In other words, the invention is not limited by the method of mounting the thermistor elements.

According to a bump mounting method, bumps are inserted between the external electrode layers of the thermistor element and a circuit board and heat is applied to connect the bumps to the wires or lead terminals on the circuit board as well as to the external electrode layers of the thermistor element such that the thermistor element are connected both mechanically and electrically to the mounting board.

Au, Au alloys and Sn—Pb alloys are commonly used for bumps. The external electrode layers are of a material such as Au, Ag, Pd, Pt, Sn and their alloys, according to the kind of the bump material such that the reliability of connection by the bump bonding can be even more improved. If the bumps comprise Au or a Au alloy, the external electrode layers are preferably formed with Au or a Au alloy. In other words, the reliability of bonding between the bumps and the external electrode layer can be improved if they both contain a same metal.

According to a preferred embodiment of this invention, the contact layers of the pair of electrodes are formed only on one surface of the thermistor body on which the pair of electrodes is formed opposite each other. Although the contact layers are not prevented from extending over to other surfaces of the thermistor body, formation of fillets can be reliably prevented when a solder flow or reflow method is used if the contact layers are only on the surface of the thermistor body on which the pair of mutually opposite electrodes is formed.

The contact layers are preferably of a metallic material such as Ni, Cr, Cu, Au, Ag and their alloys capable of reliably forming an ohmic contact with the thermistor body. The desired characteristics of the thermistor element can thus be dependably delivered through its electrodes.

The external electrode layers may be formed either directly over the contact layers or indirectly with an intermediate layer or two in between. There may be a single intermediate layer of a material such as Ni, Cu and their alloys, or there may be a second intermediate layer of a material such as Au, Ag, Pd, Pt, Sn and their alloys between the first intermediate layer and the contact layer. An intermediate layer of Ni, Cu or their alloy serves to form an alloy with a solder even if the external electrode layer is invaded such that a sufficiently strong bonding can be preserved and hence the thermistor element can be mounted also by a solder flow or reflow method. The second intermediate layer as described above serves to improve mechanical connections between contact layers and external layers.

It is preferable to also provide an insulative resin layer which will cover at least a portion of the same surface of the thermistor body on which the electrodes are formed opposite each other. Such an insulative resin layer serves to improve the resistance of the thermistor element against moisture and to prevent attachment of solder bridges when the thermistor element is mounted by a solder reflow or flow method, reducing the possibility of shorting between the electrodes even if the distance of their separation is relatively small. Such an insulative resin layer may be formed so as to cover portions of the electrodes such as their edge areas which are opposite each other or to extend over to surfaces other than the one on which the electrodes are formed.

There may be provided a second insulative resin layer on the surface of the thermistor body opposite to the one on which the electrodes are formed. The resistance of the thermistor element against moisture can be further improved with two surfaces of the thermistor body thus covered with insulative resin layers.

The pair of electrodes is not limited to be formed only on one surface. They may be formed opposite each other on different surfaces of the thermistor body.

BRIEF DESCRIPTION OF THE DRAWINGS:

The accompanying drawings, which are incorporated in and form a part of this specification, illustrate embodiments of the invention and, together with the description, serve to explain the principles of the invention. In the drawings.

Throughout herein, like components are indicated by the same symbols even if they are of different embodiments and may not be explained repetitively.

DETAILED DESCRIPTION OF THE INVENTION

Figure 1A:
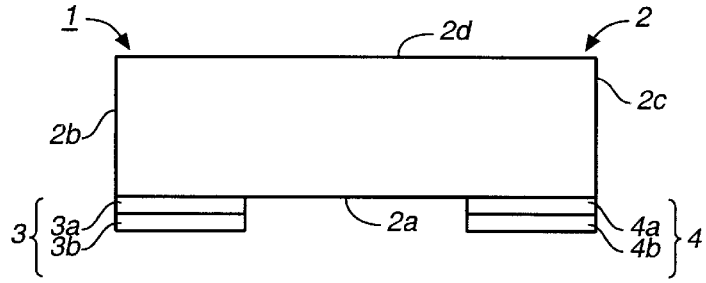
FIGS. 1A and 1B are respectively a side view and a bottom view of a thermistor element according to a first embodiment of this invention.
Figure 1B:
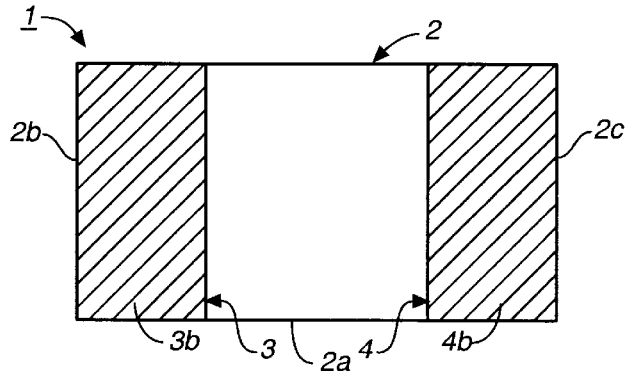

The invention is described next by way of several embodiments. FIGS. 1A and 1B show an NTC thermistor element 1 according to a first embodiment of this invention, having a thermistor body 2 which is comprised of a sintered member made of oxides of a plurality of transition metals with resistance having a negative temperature coefficient (NTC). The thermistor body 2 is of the shape of a rectangular parallelepiped and a pair of electrodes (the first electrode 3 and the second electrode) is formed on the lower surface 2*a* of the thermistor body 2. The first electrode 3 is formed, extending from an edge on a left-hand end surface 2*b* towards the center, and the second electrode 4 is formed, extending from an opposite edge on a right-hand end surface 2*c* towards the center on the lower surface 2*a*, the two end surfaces 2*b* and 2*c*, as well as the upper surface 2*d*, being totally uncovered and exposed. There is no electrode at the center of the lower surface 2*a* such that the first and second electrodes 3 and 4 are opposite to each other in a mutually face-to-face relationship on the lower surface 2*a*.

The first and second electrodes 3 and 4 each have a contact layer 3*a* or 4*a* and an external electrode layer 3*b* or 4*b* formed on the corresponding contact layer 3*a* or 4*a*. The contact layers 3*a* and 4*a* comprise a material capable of making an ohmic contact with the thermistor body 2 such as Cr, Ni, Cu, Au, Ag and their alloys such as Ni—Cr and Ni—Cu alloys and they are formed by a method for forming a thin film such as vapor deposition, sputtering, electroless plating and electrolytic plating. According to the embodiment being described here, the contact layers 3*a* and 4*a* are formed on the thermistor body 2 by vacuum vapor deposition of Ni—Cr alloy, as will be explained below. It is to be noted that, since the contact layers 3*a* and 4*a* according to this invention are formed by a method for forming a thin film, they have less surface protrusions and indentations than the thick-film electrodes formed by applying and baking a conductive paste. If the lower surface 2*a* on which the electrodes are to be formed is polished, say, by using diamond particles prior to the formation of the contact layers to make it smoother, the outer surfaces of the external electrode layers 3*b* and 4*b* will have even less protrusions and indentations.

The external electrode layers 3*b* and 4*b* are provided for making reliable external electrical connections. According to the present embodiment of the invention, they are made of Au films but other materials such as Ag, Pd, Pt and Sn, as well as alloys of these metals such as Ag—Pd, Au—Sn, Au—Si and Au—Ge may be used.

Because the external electrode layers 3*b* and 4*b* are made of such a material, the thermistor element 1 can be easily surface-mounted by a bump bonding method with a bump made of a material such as Au and a Sn—Pd alloy. Since these external electrode layers 3*b* and 4*b* are formed over the contact layers 3*a* and 4*a* with smooth surfaces, they also have smooth surfaces and hence can make reliable connections by a bump bonding method.

Next, the production process of the thermistor element 1 will be described with reference to FIGS. 2–5.

Figure 2A:
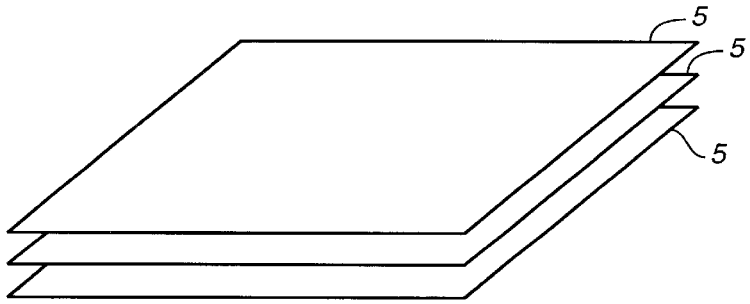
FIGS. 2A, 2B, 2C and 2D are schematic sketches for showing a production process for obtaining thermistor elements according to the first embodiment of the invention.
Figure 2B:
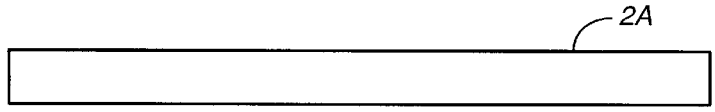

First, oxides of Mn, Ni and Co were mixed and kneaded together with a binder to obtain a slurry and this slurry was used to make a sheet by a doctor blade method. The sheet thus obtained with a specified thickness was cut to obtain a plurality of green sheets 5, as shown in FIG. 2A. These green sheets 5 were stacked one on top of another and after they were compressed together in the direction of the thickness, they were baked at a temperature of about 1300° C. for one hour to obtain a thermistor body wafer 2A of dimensions 50×50×0.5 mm (FIG. 2B).

Figure 2C:
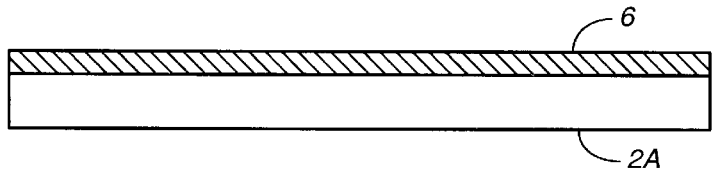
Figure 2D:
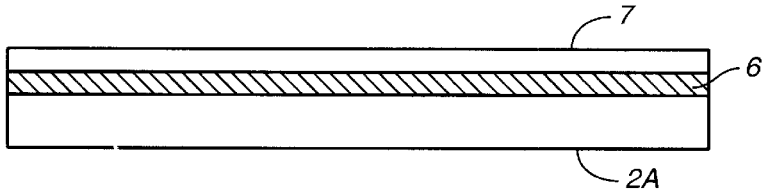

Next, a film of a Ni—Cr alloy with thickness 0.2 $\mu$m was formed on this thermistor body wafer 2A by vacuum vapor deposition with heating, and an Au film of the same thickness 0.2 $\mu$m was formed thereover to produce a layered metal film 6 as shown in FIG. 2C. Although FIGS. 2C and 2D represent this metal film 6 as a uniform single layer, it actually has the structure, as described above, of an Au film formed over a Ni—Cr alloy film. Thereafter, a film of photoresist 7 with thickness 2 $\mu$m was formed on the layered metal film 6 by a spin coating method, as shown in FIG. 2D.

Figure 3A:
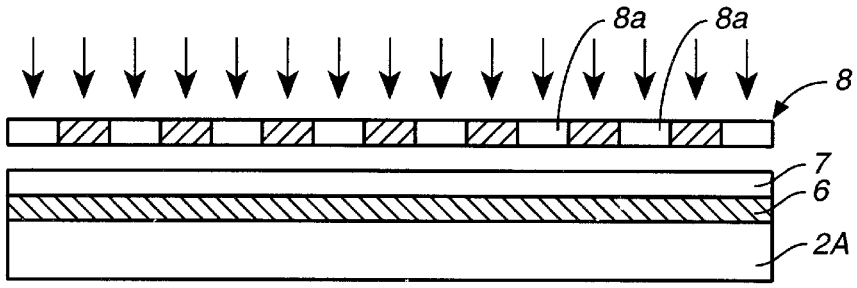
FIGS. 3A, 3B, 3C, 3D and 3E are schematic sectional views for further showing the production process for the thermistor elements according to the first embodiment of the invention.
Figure 3B:
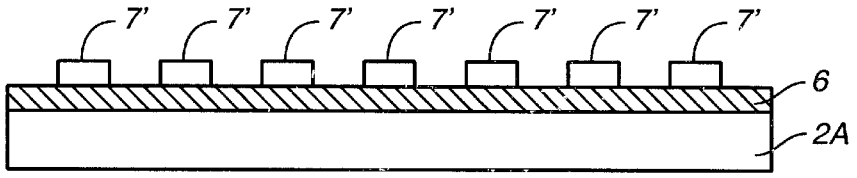
Figure 4A:
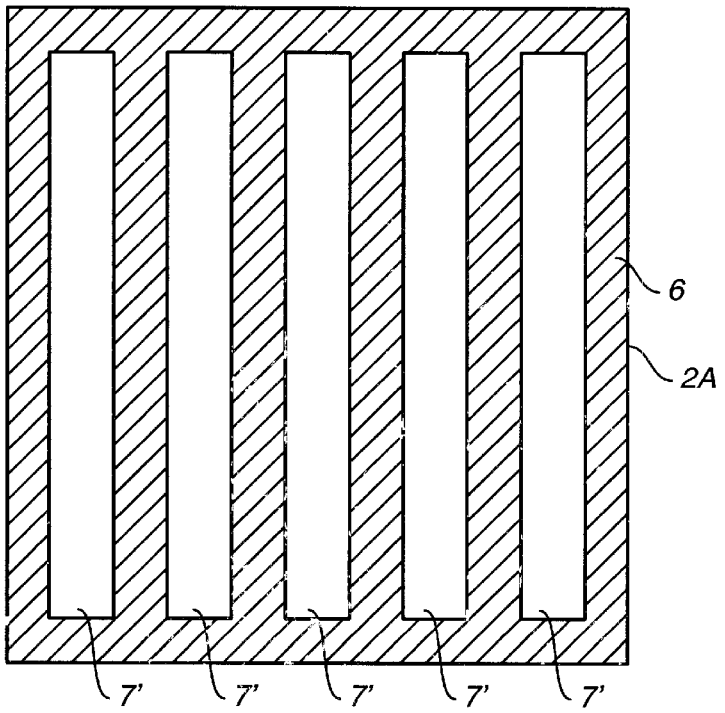
FIGS. 4A and 4B are plan views respectively corresponding to FIGS. 3B and 3C.

Next, as shown in FIG. 3A, a photo-mask 8 was placed over the photoresist 7, it was exposed to light and the photoresist 7 was developed by means of a solvent to produce a photoresist pattern 7' as shown both in FIGS. 3B and 4A. The photo-mask 8 has a plurality of openings 8*a* such that layered metal film pieces 6' to be described below will eventually be formed on the areas between a mutually adjacent pair of these openings 8*a*. The size of these openings 8*a* was determined such that the separation between mutually adjacent pairs of these layered metal film pieces 6' would become 200 $\mu$m.

Figure 3C:
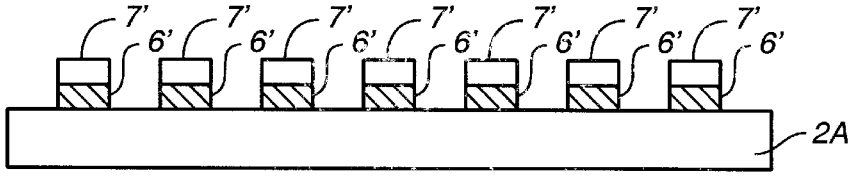
Figure 4B:
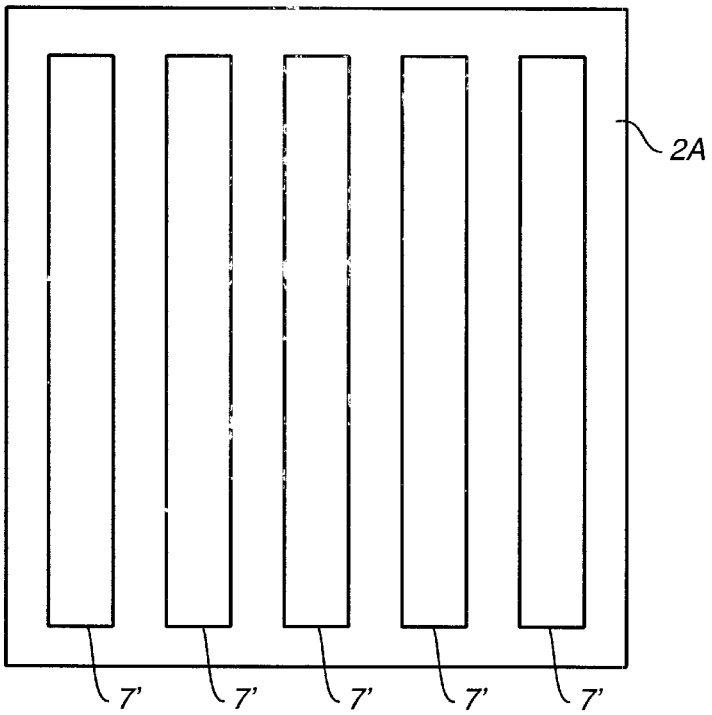
Figure 5:
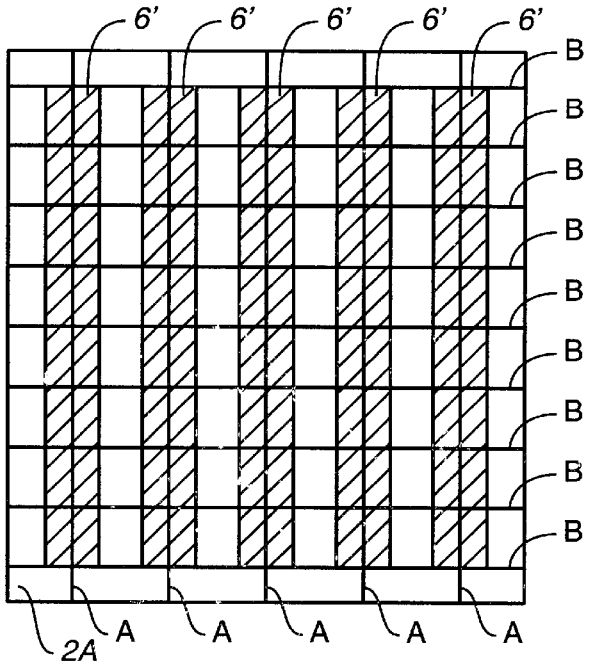
FIG. 5 is a plan view corresponding to FIG. 3E.

Next, as shown in FIG. 3C, the parts of the layered metal film not covered by the photoresist pattern 7' were etched away by means of an acid. This was done first by etching the Au film portion of the layered metal film 6 by means of an acid and then etching the Ni—Cr film so as to leave only the layered metal film pieces 6' covered by the photoresist pattern 7', as shown in FIGS. 3C and 4B.

Figure 3D:
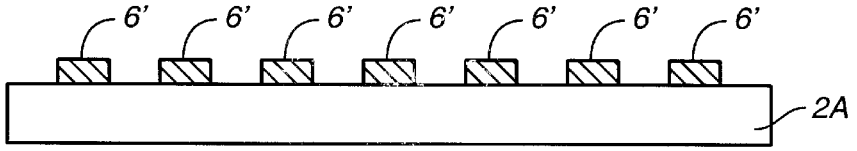
Figure 3E:
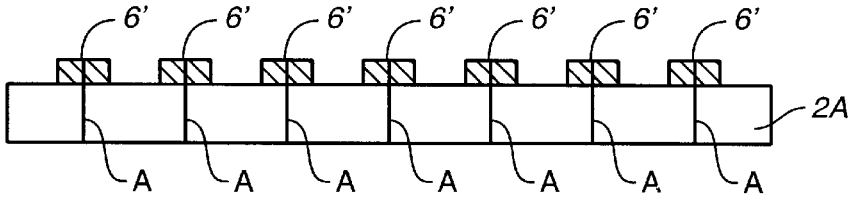

Next, the photoresist pattern 7' was removed to obtain the patterned layered metal film pieces 6' on the thermistor body wafer 2A, as shown in FIG. 3D. This was then cut along lines A and B shown in FIGS. 3E and 5 to obtain a plurality of thermistor elements 1 of a planar shape with dimensions 1.6×0.8 mm.

Figure 6A:
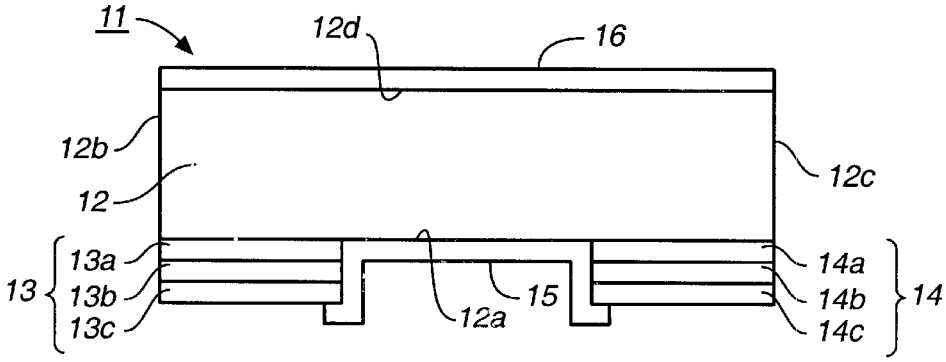
FIGS. 6A and 6B are respectively a side view and a bottom view of another thermistor element according to a second embodiment of this invention.
Figure 6B:
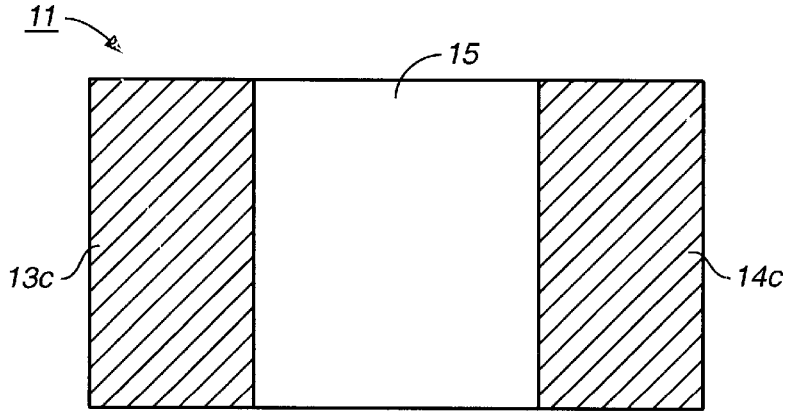

FIGS. 6A and 6B show another thermistor element 11 according to a second embodiment of this invention, having its thermistor body 12 structured as described above with respect to the thermistor body 2 and a first electrode 13 and a second electrode 14 formed on the lower surface 12*a* of the thermistor body 12. The first and second electrodes 13 and 14 each have a contact layer 13*a* or 14*a*, an intermediate layer 13*b* or 14*b* and an external electrode layer 13*c* or 14*c*. These contact layers 13*a* and 14*a* and external electrode layers 13*c* and 14*c* are structured like the contact layers 3*a* and 3*b* and the external electrode layers 3*b* and 4*b* described above with reference to the first embodiment of the invention, formed such that they do not reach the end surfaces 12*b* and 12*c* of the thermistor body 12. The difference between the first and second embodiments of the invention is that the thermistor element 11 of the second embodiment is additionally provided with the intermediate layers 13*b* and 14*b*.

The intermediate layers 13*b* and 14*b* may be formed, for example, by vacuum vapor deposition of Ni. They may be formed also with Cu, or further with an alloy of Cu or Ni. They may be formed not only by vacuum vapor deposition but also by another method of forming a thin film such as the sputtering method, the ion plating method or the electroless or electrolytic plating method.

Since the first and second electrodes 13 and 14 are formed opposite to each other on the lower surface 12*a* of the thermistor body 12 and do not reach the other surface thereof, the thermistor body 12 can be surface-mounted easily through its lower surface 12*a* onto a printed circuit board or the like. Since the electrodes 13 and 14 do not reach the other surfaces, metal fillets are not likely to form when a solder flow or reflow process is used for making connections. Moreover, since the external electrode layers 13*c* and 14*c* are formed on the contact layers 13*a* and 14*a* with little unevenness, as in the case of the first embodiment of the invention described above, these external electrode layers 13*c* and 14*c* can also be formed with few protrusions and indentations. As a result, a surface mounting onto a printed surface or the like can be more reliably effected by a bump bonding process.

According to the second embodiment of the invention, there is further formed a (first) insulative resin layer 15 comprising polyimide on the lower surface 12*a* of the thermistor body 12 and also another (second) insulative resin layer 16 comprising polyimide on the upper surface 12*d* of the thermistor body 12 so as to improve its moisture resistance and temperature characteristic. Moreover, undesirable short-circuiting between the first and second electrodes 13 and 14 can be effectively prevented since the first insulative resin layer 15 is formed so as to cover at least the portion of the lower surface 12*a* of the thermistor body 12 other than the areas over which the first and second electrodes 13 and 14 are formed. The first insulative resin layer 15 on the lower surface 12*a* of the thermistor body 12 may be formed, as shown in FIG. 6A, so as to also cover edge surfaces and portions of the first and second electrodes 13 and 14. Although FIG. 6A shows the second insulative resin layer 16 as covering the upper surface 12*d* of the thermistor body 12, such a second insulative resin layer is not essential and hence may be dispensed with. The first and second insulative resin layers need not comprise polyimide. They may comprise a resin material of a different kind with superior moisture resistance such as epoxy resin and fluorine-containing resin.

Figure 7A:
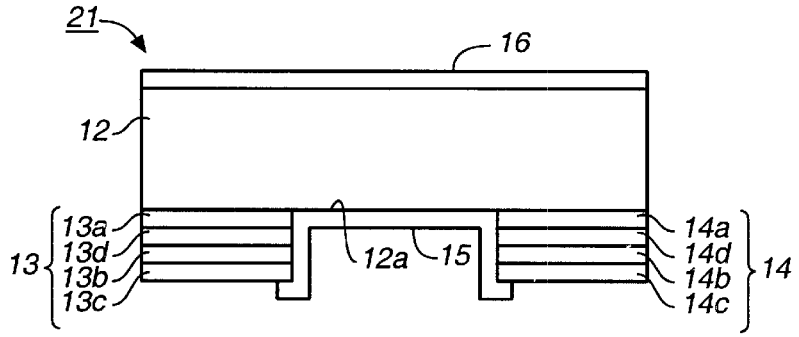
FIGS. 7A and 7B are respectively a side view and a bottom view of still another thermistor element according to a third embodiment of this invention.
Figure 7B:
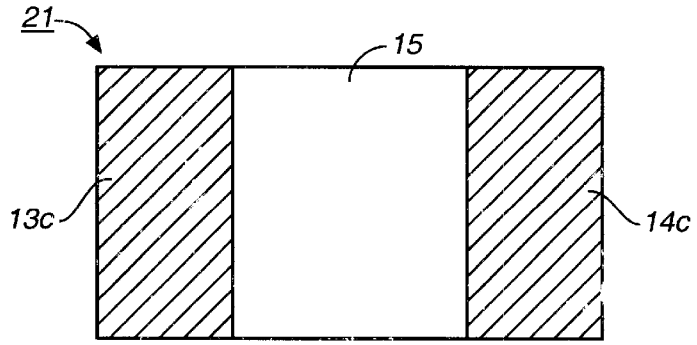

FIGS. 7A and 7B show still another thermistor element 21 according to a third embodiment of this invention, which is identical to the thermistor element 11 according to the second embodiment described above except for second intermediate layers 13*d* and 14*d* provided in addition. Thus, like components in FIGS. 7A and 7B are indicated by the same symbols as in FIGS. 6A and 6B and are not described repetitiously.

These second intermediate layers 13*d* and 14*d* are formed respectively between the contact layer 13*a* and the (first) intermediate layer 13*b* of the first electrode 13 and between the contact layer 14*a* and the (first) intermediate layer 14*b* of the second electrode 14. They may be formed, for example, by vacuum vapor deposition of Pd. They may also comprise Ag, Au, Pt or an alloy containing Pd, Ag, Au or Pt. They may be formed by a method other than vacuum vapor deposition for forming a thin film such as the sputtering method, the ion plating method or the electroless or electrolytic plating method.

When the thermistor element 21 has been mounted by solder bumps, the first intermediate layers 13*b* and 14*b* serve to improve the bonding strength with the solder bumps, and the external electrode layers 13*c* and 14*c* comprising Au serve not only to prevent the oxidation of the first intermediate layers 13*b* and 14*b* comprising Ni due to the oxygen in the air but also to improve the bonding strength between the bumps, if they comprise Au or an alloy containing Au, and the first and second electrodes 13 and 14.

When the bonding is made to solder bumps or when the bonding is effected by a solder flow or reflow method of mounting, there is a possibility that the external electrode layers 13*c* and 14*c* comprising Au may form an alloy with the solder to thereby erode the solder but the solder forms an alloy with the nickel which forms the first intermediate layers 13*b* and 14*b* such that the solder becomes bonded to the first intermediate layers 13*b* and 14*b*, thereby improving the bonding strength therebetween. So, a thermistor element thus formed is suited for any of the mounting methods such as the bump mounting using solder bumps, the bump mounting using Au bumps and flow or reflow mounting method using a solder.

The second intermediate layers 13*d* and 14*d* comprising Pd, which are additionally provided on the contact layers 13*a* and 14*a* according to this embodiment of the invention, serve to further improve the attachment of the films of the first intermediate layers 13*b* and 14*b* by electrolytic plating.

Figure 8A:
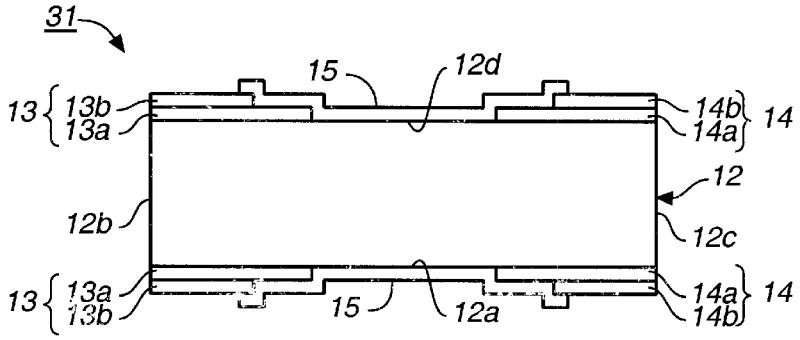
FIGS. 8A and 8B are respectively a side view and a bottom view of still another thermistor element which is a variation of the second embodiment of this invention.
Figure 8B:
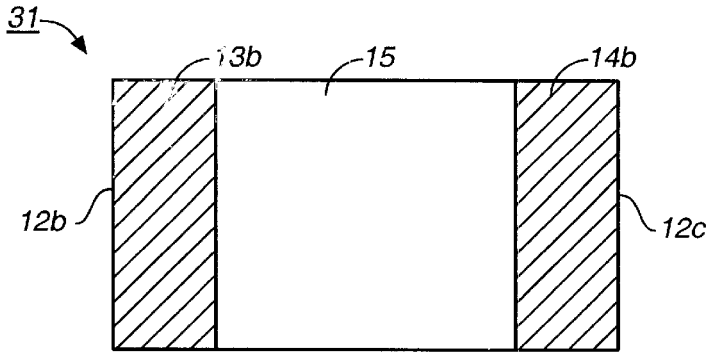

The embodiments described above are not intended to limit the scope of the invention. FIGS. 8A and 8B show a thermistor element 31 which may be considered a variation of the thermistor element 11 according to the second embodiment of the invention described above with reference to FIGS. 6A and 6B, being different therefrom wherein first and second electrodes 13 and 14 and an insulative resin layer 15 are formed not only on the lower surface 12*a* of the thermistor body 12 but also similarly on its upper surface 12*d*. In other words, the first and second electrodes may be formed according to this invention on more than one surface of the thermistor body.

Figure 9A:
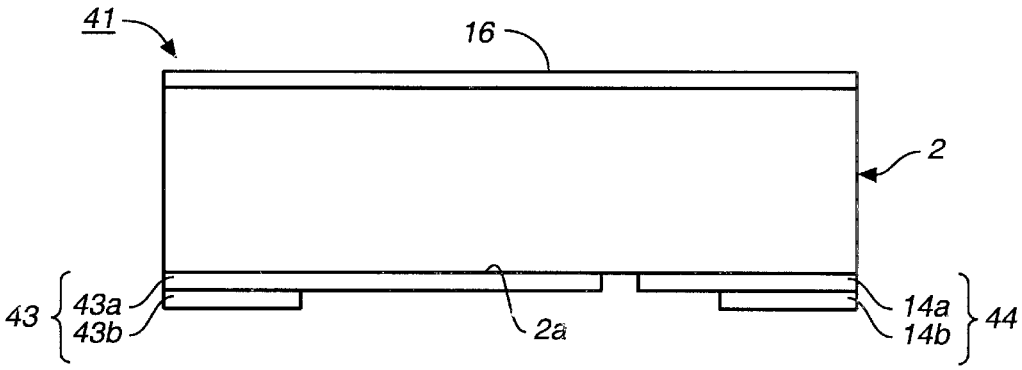
FIGS. 9A and 9B are respectively a side view and bottom view of still another thermistor element which is another variation according to this invention.
Figure 9B:
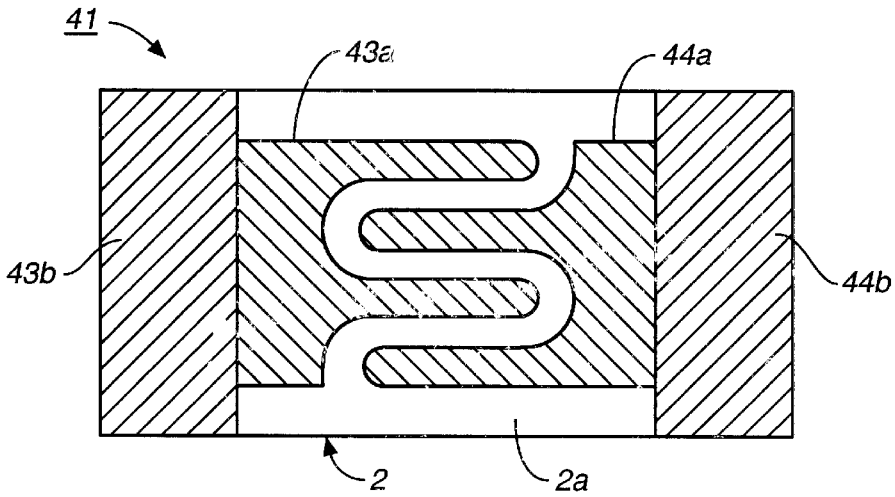

FIGS. 9A and 9B show still another thermistor element 41 which is another variation according to this invention, being different from the first embodiment of the invention described above with reference to FIGS. 1A and 1B wherein the contact layers 43*a* and 44*a* respectively of the first and second electrodes 43 and 44 are shaped differently like combs with fingers protruding towards each other, the external electrode layers 43*b* and 44*b* being of the same shapes as those according to the first embodiment of the invention. With the contact layers 43*a* and 44*a* thus formed in the shape of combs, it is possible to provide thermistor bodies having the same shape but different resistance values. Generally, the manner in which the first and second electrodes are formed opposite each other may be appropriately varied.

The materials for the contact layers 43*a* and 44*a* and the external electrode layers 43*b* and 44*b* may be appropriately selected as described above for the various embodiments. For example, the contact layers 43*a* and 44*a* may comprise an Ni—Cr alloy and the external electrode layers 43*b* and 44*b* may comprise a Au—Sn alloy.

Figure 10:
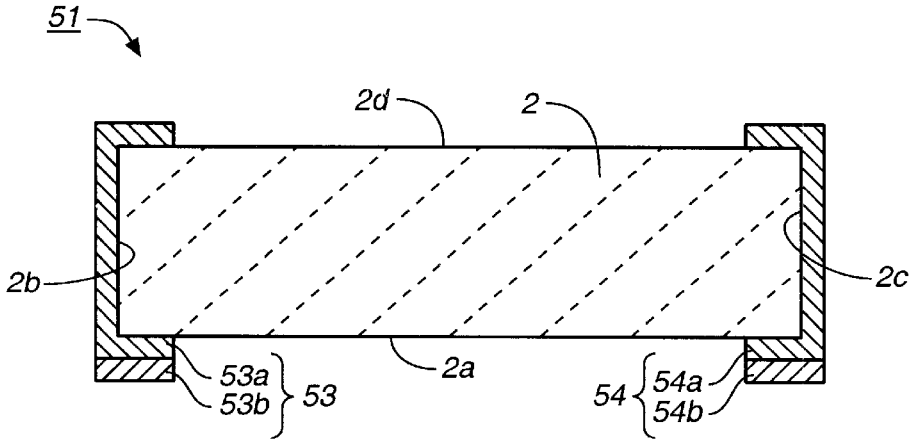
FIG. 10 is a sectional side view of still another thermistor element according to this invention.

FIG. 10 shows still another thermistor element 51 according to this invention characterized as having its electrodes 53 and 54 formed such that their contact layers 53*a* and 54*a* extend to surfaces other than the one on which they are formed opposite each other. Explained more in detail, the first and second electrodes 53 and 54 are formed opposite each other on the lower surface 2*a* of the thermistor body 2 but the contact layers 53*a* and 54*a* of these electrodes 53 and 54 are formed not only on the lower surface 2*a* of the thermistor body 2 but also so as to extend to the end surfaces 2*b* and 2*c* as well as to the upper surface 2*d* of the thermistor body 2. The external electrode layers 53*b* and 54*b* are formed, however, only on the lower surface 2*a* of the thermistor body 2 on which the contact layers 53*a* and 54*a* of the electrodes 53 and 54 are formed opposite each other. Thus, thermistor elements thus structured, too, can be mounted to a printed circuit board or the like at a high density by a bump bonding method.

Figure 14A:
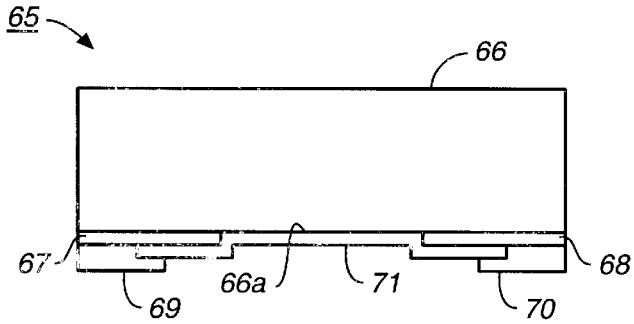
FIG. 14A (PRIOR ART)
FIGS. 14A and 14B are respectively a side view and a bottom view of another prior art thermistor element.
Figure 14B:
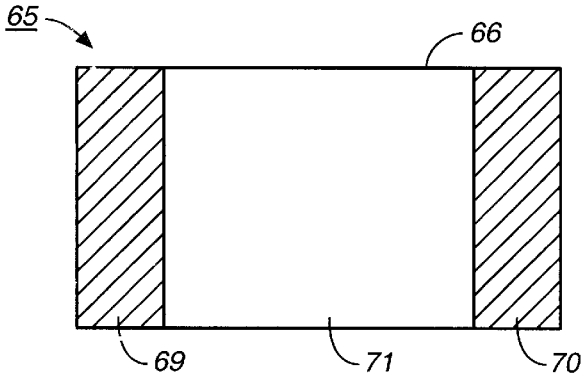
FIG. 14B (PRIOR ART)

Test experiments were carried out to demonstrate that thermistor elements according to this invention, bump-mounted to a printed circuit board, are more resistant against moisture than prior art thermistor elements mounted to a printed circuit board by plating in a conventional way. First, a thermistor element 1 according to the first embodiment of this invention ("the test sample") was prepared and mounted to a printed circuit board by an Au bump bonding method. Next, for comparison, a thermistor element ("the comparison sample") as shown at 65 in FIGS. 14A and 14B with electrodes 67 and 68 of a three-layer structure (the electrodes 67 and 68 comprising a Ag layer and the external electrodes 69 and 70 comprising a Ni layer and a Sn layer) was prepared and mounted to a printed circuit board by a reflow soldering method. These two mounted thermistor elements were left for 1000 hours at 85° C. and the fractional changes of their resistance values were measured in the meantime. The results are shown in FIG. 11.

Figure 11:
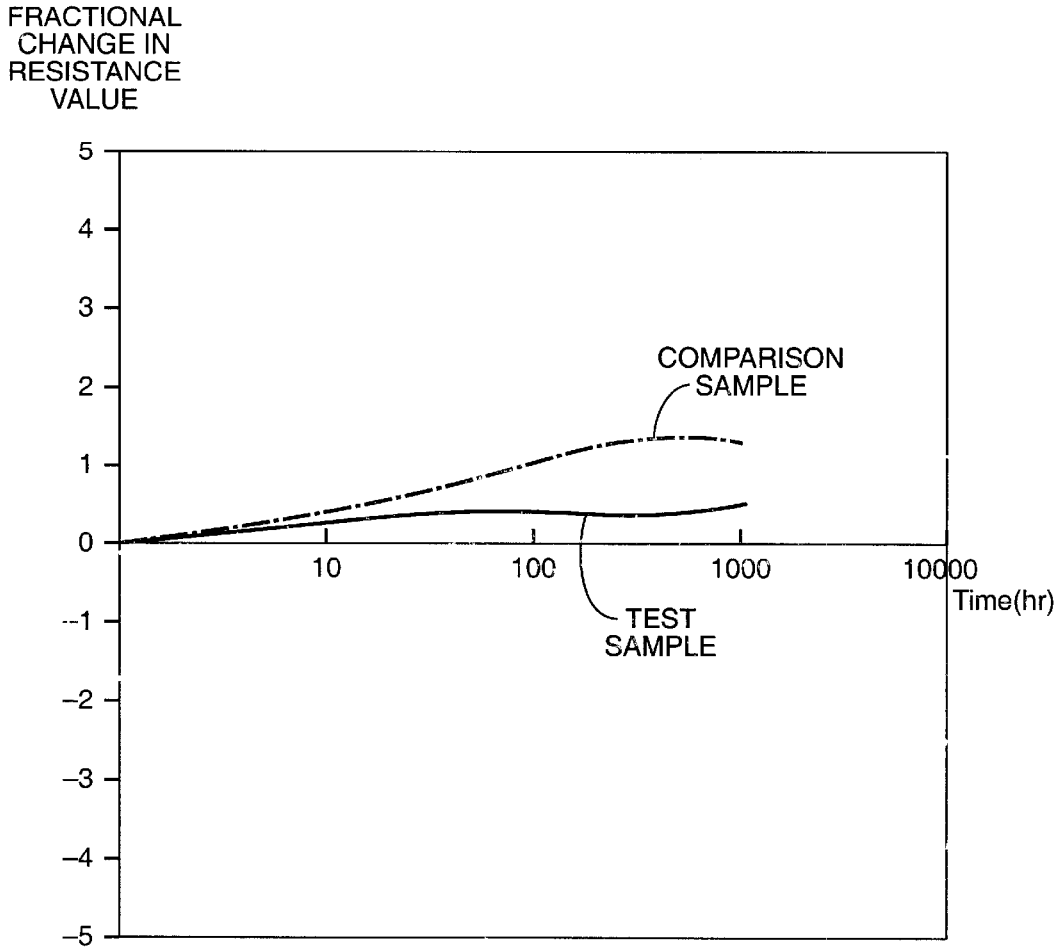
FIG. 11 is a graph which shows the result of a test on the fractional change with time in resistance value.

FIG. 11 clearly shows that the fractional change after 1000 hours in the resistance value of the test example is less than 1% which is much smaller than that of the comparison sample. This is because the mechanical bonding strength and the electrical connection in the case of the comparison sample are adversely affected by the solder embrittlement while the mechanical strength of the Au bump bonding for the thermistor element according to this invention (that is, the test sample) is hardly affected and its temperature characteristic is improved.

Figure 12:
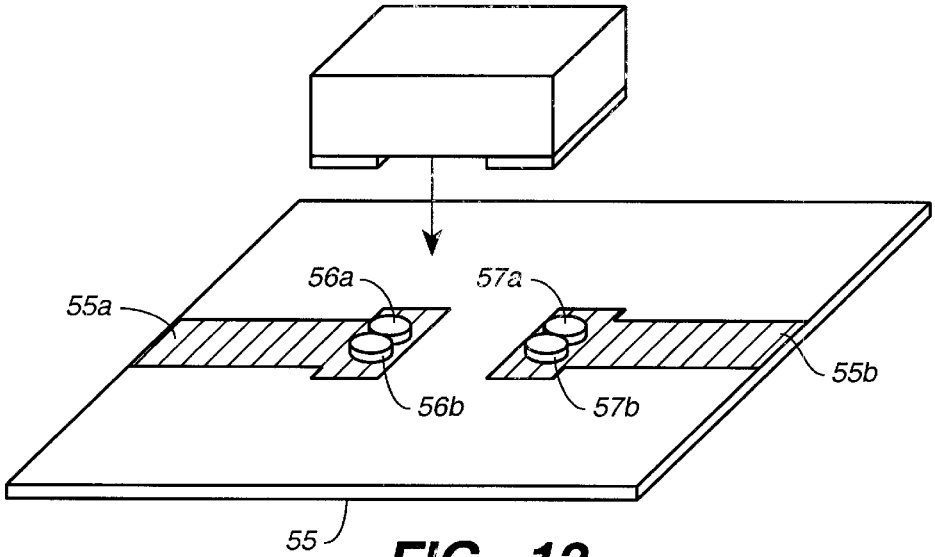
FIG. 12 is a schematic diagonal view of a printed circuit board for explaining a bonding process for mounting a thermistor element for testing.
Figure 13A:
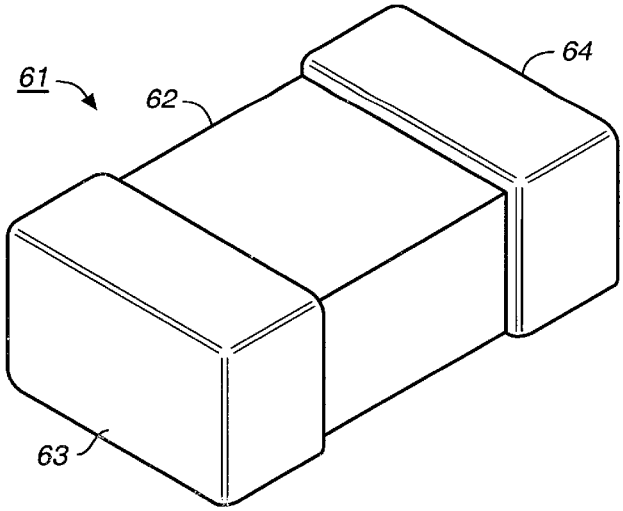
FIG. 13A (PRIOR ART)
FIGS. 13A and 13B are respectively a diagonal view and a sectional view of a prior art thermistor element.
Figure 13B:
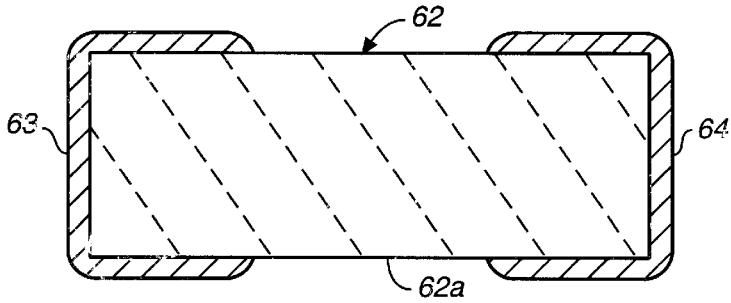
FIG. 13B (PRIOR ART)

As another test, thermistor elements according to the first through third embodiments of the invention were mounted to printed circuit boards both by Au bump bonding and solder bump bonding methods. For comparison, thermistor elements as shown at 65 in FIGS. 14A and 14B were also mounted to printed circuit boards both by Au bump bonding and solder bump bonding methods. For each of the Au bump bonding of a thermistor element, an alumina board 55 with strip lines 55*a* and 55*b* comprising Au thereon was prepared as shown in FIG. 12. Two cylindrical Au bumps 56*a* and 56*b* or 57*a* and 57*b* of diameter 50 $\mu$m and thickness 20 $\mu$m were placed on each of the strip lines 55*a* or 55*b* for each of the electrodes on the thermistor element, and the mounting was effected at temperature 400° C. and pressure 50 g. Each of the solder bump bonding was carried out similarly except the strip lines 55*a* and 55*b* were formed by solder plating, solder bumps with the same dimensions were used instead of the Au bumps, and the mounting was effected at temperature 150° C. and pressure 20 g.

The bonding of each mounted thermistor element was considered "good" if all of the bumps 56*a*, 56*b*, 57*a* and 57*b* were found to be bonded when the mounted board was observed from a side. If even one of the bumps 56*a*, 56*b*, 57*a* and 57*b* was found to be not bonded, it was considered "defective". Results of evaluation (percentage of "good" samples over evaluated samples for each category) are shown in Table 1.

TABLE 1

| Samples (Number of samples) | Comparison (65) | Embodiment No. 1 (1) | Embodiment No. 2 (11) | Embodiment No.3 (21) |
|---|---|---|---|---|
| By Au bump mounting method | 1.2% | 100% | — | — |
| By solder bump mounting method | 15.3% | — | 99.8% | 99.3% |

What is claimed is:

1. A thermistor element comprising a thermistor body having a lower surface, an upper surface which is opposite said lower surface and is totally exposed, a mutually oppositely facing pair of totally exposed end surfaces adjacent said lower surface, a first electrode and a second electrode, said first electrode and said second electrode being disposed away from each other on said lower surface of said thermistor body in ohmic contact with said lower surface, said first electrode and said second electrode each being formed only on said lower surface and comprising a contact layer and an external electrode layer, said external electrode layer being disposed directly or indirectly over said contact layer, said external electrode layer comprising a metallic material including Au and one or more alloys selected from the group consisting of alloys of Au, Ag, Pd, Pt and Sn.

2. The thermistor element of claim 1 wherein said contact layer is disposed only on said lower surface.

3. The thermistor element of claim 2 wherein said contact layer comprises a metallic material selected from the group consisting of Ni, Cr, Cu, Au, Ag and alloys thereof.

4. The thermistor element of claim 2 further comprising an insulative resin layer over at least a portion of said lower surface, neither said first electrode nor said second electrode being disposed on said portion.

5. The thermistor element of claim 4 further comprising another insulative resin layer on another surface of said thermistor body opposite from said lower surface.

6. The thermistor element of claim 1 wherein said contact layer comprises a metallic material selected from the group consisting of Ni, Cr, Cu, Au and Ag and alloys thereof.

7. The thermistor element of claim 1 further comprising an insulative resin layer over at least a portion of said lower surface, neither said first electrode nor said second electrode being disposed on said portion.

8. The thermistor element of claim 7 further comprising another insulative resin layer on another surface of said thermistor body opposite from said lower surface.

9. A thermistor element comprising a thermistor body having a lower surface, an upper surface which is opposite said lower surface and totally exposed, a mutually oppositely facing pair of totally exposed end surfaces adjacent said lower surface, a first electrode and a second electrode, said first electrode and said second electrode being disposed away from each other on said lower surface of said thermistor body in ohmic contact with said lower surface, said first electrode and said second electrode each being formed only on said lower surface and comprising a contact layer and an external electrode layer, said external electrode layer being disposed directly or indirectly over said contact layer, said external electrode layer comprising a metallic material selected from the group consisting of Au, Ag, Pd, Pt, Sn and alloys thereof, wherein said contact layer comprises a metallic material selected from the group consisting of Ni, Cr, Cu, Au and Ag and alloys thereof, and wherein said first electrode and said second electrode each further comprise a first intermediate layer provided between said contact layer and said external electrode layer, said first intermediate layer comprising a metallic material selected from the group consisting of Ni, Cu and alloys thereof.

10. The thermistor element of claim 9 wherein said contact layer is disposed only on said lower surface.

11. The thermistor element of claim 10 wherein said first electrode and said second electrode each further comprise a second intermediate layer provided between said contact layer and said first intermediate layer, said second intermediate layer comprising a metallic material selected from the group consisting of Au, Ag, Pd, Pt, Sn and alloys thereof.

12. The thermistor element of claim 9 wherein said first electrode and said second electrode each further comprise a second intermediate layer provided between said contact layer and said first intermediate layer, said second intermediate layer comprising a metallic material selected from the group consisting of Au, Ag, Pd, Pt, Sn and alloys thereof.

13. A thermistor element comprising:

a planar thermistor body having a pair of mutually oppositely facing end surfaces, a lower surface which extends between said end surfaces and an upper surface which is opposite said lower surface, said end surfaces and said upper surface being uncovered and externally exposed;

a first electrode entirely on said lower surface and in ohmic contact with said lower surface; and a second electrode entirely on said lower surface away from said first electrode and in ohmic contact with said lower surface, said first electrode and said second electrode each comprising a contact layer and an external electrode layer, said external electrode layer being disposed directly or indirectly over said contact layer and only on said lower surface, said external electrode layer comprising a metallic material including Au and one or more alloys selected from the group consisting of alloys of Au, Ag, Pd, Pt and Sn.

14. The thermistor element of claim 13 wherein said contact layer comprises a metallic material selected from the group consisting of Ni, Cr, Cu, Au, Ag and alloys thereof.

15. The thermistor element of claim 13 further comprising an insulative resin layer over at least a portion of said lower surface, neither said first electrode nor said second electrode being disposed on said portion.

16. The thermistor element of claim 15 further comprising another insulative resin layer on another surface of said thermistor body opposite from said lower surface.

17. A thermistor element comprising:

a planar thermistor body having a pair of mutually oppositely facing end surfaces, a lower surface which extends between said end surfaces and an upper surface which is opposite said lower surface, said end surfaces and said upper surface being uncovered and externally exposed;

a first electrode entirely on said lower surface and in ohmic contact with said lower surface; and a second electrode entirely on said lower surface away from said first electrode and in ohmic contact with said lower surface, said first electrode and said second electrode each comprising a contact layer and an external electrode layer, said external electrode layer being disposed directly or indirectly over said contact layer and only on said lower surface, said external electrode layer comprising a metallic material selected from the group consisting of Au, Ag, Pd, Pt, and Sn and alloys thereof;

wherein said first electrode and said second electrode each further comprise a first intermediate layer provided between said contact layer and said external electrode layer, said first intermediate layer comprising a metallic material selected from the group consisting of Ni, Cu and alloys thereof.

18. The thermistor element of claim 17 wherein said first electrode and said second electrode each further comprise a second intermediate layer provided between said contact layer and said first intermediate layer, said second intermediate layer comprising a metallic material selected from the group consisting of Au, Ag, Pd, Pt, Sn and alloys thereof.

* * * * *